US005436050A

United States Patent [19]

Carriker et al.

[11] Patent Number: 5,436,050

[45] Date of Patent: Jul. 25, 1995

[54] TUFTED GEOSYNTHETIC CLAY LINER AND METHOD OF MANUFACTURE THEREOF

[75] Inventors: Richard Carriker, Woodstock; Mark Clarey, Dalton, both of Ga.

[73] Assignee: James Clem Corporation, Chicago, Ill.

[21] Appl. No.: 6,227

[22] Filed: Jan. 19, 1993

[51] Int. Cl.[6] ..... B32B 3/02; D05C 17/02; B09B 1/00; G21F 9/00

[52] U.S. Cl. ..... 428/87; 428/92; 428/94; 428/95; 112/410; 405/129

[58] Field of Search ..... 112/410; 428/92, 87, 428/95, 94; 405/129

[56] References Cited

U.S. PATENT DOCUMENTS

| | | | |
|---|---|---|---|
| 423,781 | 3/1890 | Landenberger | 428/95 |
| 3,847,719 | 11/1974 | Crowley | 428/92 |
| 4,565,468 | 1/1986 | Crawford | 428/102 |
| 5,112,665 | 5/1992 | Alexander | 428/102 |

FOREIGN PATENT DOCUMENTS

| | | | |
|---|---|---|---|
| 4125778 | 2/1993 | Germany | 428/92 |

*Primary Examiner*—George F. Lesmes
*Assistant Examiner*—Terrel Morris
*Attorney, Agent, or Firm*—Baker & McKenzie

[57] ABSTRACT

A geosynthetic clay liner is disclosed for providing barriers in landfills that substantially preclude the migration of liquids. The geosynthetic clay liner includes a layer of bentonite disposed between a primary carrier sheet and a cover sheet. The primary carrier sheet and the cover sheet are linked via plurality of tufting threads. A bight or loop portion of the tufting thread extends through to the undersurface of the lower or primary carrier sheet and is partially melted to prevent the bight portion from slipping back through the primary carrier sheet. The partially melted bight portions create an under surface with a high coefficient of friction thereby enabling the geosynthetic clay liner to be installed on steep slopes or banks of landfills or ponds.

13 Claims, 4 Drawing Sheets

TUFTED GEOSYNTHETIC CLAY LINER AND METHOD OF MANUFACTURE THEREOF

This invention relates generally to geosynthetic clay liners for use in creating a low permeability bottom layer in waste containment sites and man-made bodies of water. More particularly, the invention relates to a geosynthetic clay liner consisting of two textile sheets, known as a primary carrier sheet and a cover sheet, with a bentonite layer disposed therebetween. The primary carrier sheet and the cover sheet are connected using a tufting process and the bight or loop portions of the tufts are then melted, interlocked, knotted, looped, buttoned or otherwise fastened to prevent the tufts from pulling out of the textile sheets.

BACKGROUND OF THE INVENTION

The present invention addresses three problems: (1) the lack of stability of geosynthetic clay liners on slopes or embankments; (2) the problems associated with the use of adhesives or glue in the manufacture of geosynthetic clay liners; and (3) the requirement imposed by needlepunching process that at least one nonwoven fabric be employed in the construction of the geosynthetic clay liner.

The concept of using bentonite to create a low permeability layer for use in landfills and man-made bodies of water is well known. Bentonite is a naturally occurring clay material which expands upon being exposed to water. When dry bentonite is wetted and thereafter expands, the bentonite is capable of substantially precluding the migration of liquids through it if properly contained.

It is also well known to provide bentonite in sheet or roll form by gluing or adhering bentonite to a sheet of textile material, hereinafter known as the primary carrier sheet. Another term used interchangeably with primary carrier sheet is primary textile. An upper layer of textile material may be provided thereby disposing the bentonite between two layers of textile material. The upper layer is hereinafter referred to as the cover sheet. Other terms used interchangeably with cover sheet include secondary textile, secondary carrier sheet and scrim. The bentonite in roll-form is often referred to as a geosynthetic clay liner by those skilled in the art.

Geosynthetic clay liners (GCLs) provided in rolls are easily applied to large surface areas, such as a landfill or a man-made pond or lake, by simply unrolling the liners in a manner similar to the laying of carpet. When the bentonite is exposed to water it expands between the two textile sheets and forms a barrier with a very low permeability.

At least three problems are associated with the above technique for providing a barrier with a geosynthetic clay liner made from bentonite disposed between two textile sheets. The first problem relates to slope stability. The primary carrier sheet and the cover sheet may be made from woven fabrics that are relatively smooth. The bentonite itself becomes very slippery when it is hydrated. Without interconnection between the textile fabric layers, the geosynthetic clay liners may lack slope stability.

A second problem relates to the cost of using glue or adhesive as a means for attaching the various components of a geosynthetic clay liner together. This method of attachment is expensive because of time and energy requirements. First, the glue must be applied to the primary carrier. Then the bentonite is placed on the prepared carrier. Once the bentonite is applied to the wet glue, the glue must dry, a procedure which requires expensive equipment and which has significant energy expenses. While the use of glue has the benefit of holding the bentonite granules in place, use of glue as the sole means for holding the liner together requires repeated applications of glue and entails substantial energy in the drying process.

The prior art also teaches needlepunching and quilting as the means of initially attaching the bentonite to the primary carrier sheet. A needlepunching process requires the use of at least one nonwoven fabric for the cover sheet or the primary carrier sheet. The nonwoven fibers are pulled by the needles to interlock with the adjacent fabric sheet. Nonwoven fabrics have lower tensile strengths than woven fabrics and have higher lateral transmissivity than woven fabrics and therefore it is not as preferable to use nonwoven fabrics as woven fabrics in geosynthetic clay liners.

Thus, there is a need for an improved geosynthetic clay liner that includes bentonite disposed between a primary carrier sheet and a cover sheet which may be applied to, and retain its position, on a steep bank or slope of the landfill site or pond. There is also a need for an improved geosynthetic clay liner that can be manufactured either without the need for gluing or a reduced dependency on gluing the bentonite to the primary carrier sheet and further without using nonwoven materials.

BRIEF DESCRIPTION OF THE INVENTION

The present invention is a significant contribution to the geosynthetic clay liner art. The liner is held together with tufted connections which provide the liner with the ability to withstand shear stresses which occur in the liner when it is applied to a sloped surface. The liner may or may not include a glue or adhesive. Further, the liner provides a rough or frictional undersurface for positively engaging a steep slope or bank of a landfill or pond. The geosynthetic clay liner of the present invention may be manufactured with a high speed process in the event that the use of glue or adhesive is reduced or, in many cases, eliminated.

The geosynthetic clay liner of the present invention includes a primary carrier sheet that supports a layer of bentonite and provides an undersurface for the geosynthetic clay liner. The primary carrier sheet is preferably supplied in roll form. As the primary carrier sheet is unrolled, a layer of bentonite is deposited on the upper surface of the primary carrier sheet. A cover sheet, also preferably supplied in roll form, is then placed on top of the bentonite so that the bentonite is disposed between the primary carrier sheet and the cover sheet.

The other edges of the primary carrier sheet and the cover sheet are preferably attached together using conventional means such as sewing or otherwise. The central portions of the primary carrier sheet and the cover sheet between the outer edges are then connected with a plurality of tufting threads. Each tufting thread includes a plurality of bight portion or loops that extend through the upper surface of the cover sheet, through the bentonite layer and finally through the primary carrier sheet. A portion of the bight portion is disposed beneath the undersurface of the primary carrier sheet after installation. In order to prevent the bight portions of the tufting threads from pulling back through the primary carrier sheet and then through the cover sheet, the bight portions are deformed, interlocked, knotted, looped, buttoned, glued or otherwise attached to the undersurface of the primary carrier sheet. The preferred method of deforming the bight portions is partial melting. Heating the bight portion causes the thread to form a lump or ball which will not easily be pulled back through the fabric. By at least partially melting the bight portions or interlocking the bight portions or using one or more of the other methods listed above, the bight portions are then unable to migrate back through the primary carrier sheet and the cover sheet. The tufting threads serve as a connecting link between the secondary and primary carrier sheets.

The plurality of tufting threads may be applied in a variety of patterns such as straight, cross-hatched or zigzag. The portions of the tufting threads that extend from the upper cover sheet to the lower primary carrier sheet also help to retain the bentonite granules in position. In the preferred embodiment, enough tufting threads are used to substantially contain the granular bentonite thereby avoiding a substantial amount of shifting of the bentonite during shipment, handling and installation.

The present invention also lends itself to an improved method of manufacturing the geosynthetic clay liner by reducing the need to use of glue or adhesive in the manufacturing process.

The primary carrier sheet is supplied in roll-form and is attached to a conveyor means. The conveyor means moves the primary carrier sheet forward underneath a hopper that deposits a layer of bentonite on the upper surface of the primary carrier sheet. The primary carrier sheet, with the bentonite layer disposed thereon, is then moved forward and the cover sheet, also supplied in roll form, is laid on top of the bentonite layer. The primary carrier sheet and the cover sheet, along with the bentonite layer, are then moved forward and the outer edges of the primary carrier sheet and the cover sheet are attached to each other by sewing or other conventional attachment means. The combination, now referred to as the liner, is then is moved through a tufting machine where plurality of tufting threads are inserted through the upper cover sheet, down through the bentonite and finally through the primary carrier sheet leaving a loop or bight portion disposed beneath the primary carrier sheet.

The bight portions may be interlocked, looped or knotted or, alternatively, the liner may be passed over a heating element where the bight portions disposed below the primary carrier sheet are partially melted to prevent the bight portions from slipping or otherwise migrating back through the primary carrier and cover sheets. Further, the bight portion may be buttoned, glued or otherwise attached to the undersurface of the primary carrier sheet. Finally, the liner is rolled on to its spindle and made ready for transport.

For the melted method, the material used for the tufting threads should be selected so that the melting point of the tufting threads is similar to or below the melting point of the primary carrier sheet thereby avoiding any damage to the primary carrier sheet when the bight portions of the tufting threads are partially melted. For the looped or interlocked methods, the melting point of the tufting thread is not important.

In another preferred method of manufacture, the bight portions of the tufting are not melted but each bight portion is interlocked with at least one other adjacent bight portion. This method requires more elaborate tufting process but avoids the melting process altogether. Finally, in a less preferred method of manufacturing the present invention, the bight portions of the tufting threads are not melted but rather are glued or otherwise adhered to the under surface of the primary carrier sheet with an adhesive or glue which is preferably not water soluble.

The present invention provides a geosynthetic clay liner with a layer of bentonite disposed between a primary carrier sheet and a cover sheet without the need for gluing the bentonite to an inner surface of either the primary carrier sheet or the cover sheet. The present invention also provides the geosynthetic clay liner with a very rough undersurface. The melted bight portions of the tufting threads are rough and the plurality of melted bight portions disposed on the undersurface of the primary carrier sheet provides an undersurface with a relatively high coefficient of friction. The geosynthetic clay liner made in accordance with the preferred method of manufacturing the present invention provides a geosynthetic clay liner with interconnection between the fabric layers of the liner that will resist shear stresses present in the liner when it is applied to a sloped surface. The liner also has a rough undersurface which causes the liner to adhere to and maintain its position on slopes or banks without the danger of the entire liner sliding along a sloping side surface of a landfill or pond.

It is therefore an object of the present invention to provide an improved geosynthetic clay liner manufactured without the need for gluing the bentonite to an inner surface of either primary carrier sheet or the cover sheet.

It is another object of the present invention to provide an improved geosynthetic clay liner with at least one outer surface with a high coefficient of friction thereby enabling the geosynthetic clay liner to maintain its position on steep slopes and banks without sliding downward under the force of gravity.

Another object of the present invention is provide a method of manufacturing geosynthetic clay liners with a tufting process that provides a connection between the primary carrier sheet and the cover sheet without actually sewing the primary carrier and the cover sheets together.

DETAILED DESCRIPTION OF THE INVENTION

Figure 1:
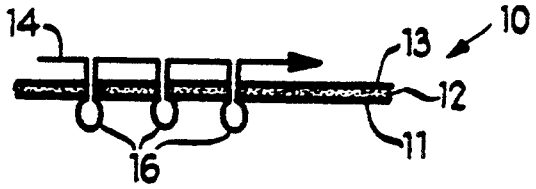
FIG. 1 is a schematic view of a single tufting thread extending through the secondary and primary carrier sheets repeatedly leaving a plurality of bight portions disposed below the primary carrier sheet.

Like reference numerals will be used to refer to like or similar parts from Figure to Figure in the following description of the drawings.

Figure 2:
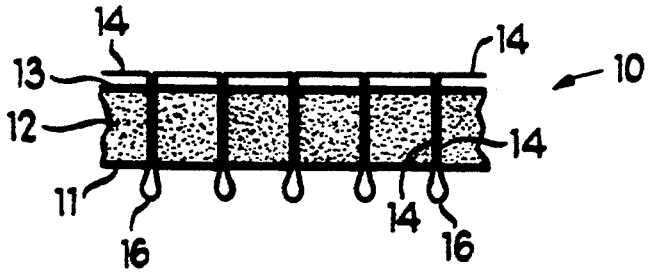
FIG. 2 is another schematic view of the tufting thread extending through the secondary and primary carrier sheets leaving bight portions disposed below the primary carrier sheet, and particularly illustrating the lack of primary carrier to cover sheet contact with the layer of bentonite disposed therebetween.

FIGS. 1 and 2 illustrate how a tufting thread provides a connecting link between the primary carrier and cover sheets. A primary carrier sheet 11 is first coated with a layer of bentonite indicated at 12. Then, a cover sheet 13 is disposed on top of the bentonite thereby creating a geosynthetic clay liner with a layer of bentonite 12 disposed between the lower or primary carrier sheet 11 and the upper or cover sheet 13. The primary carrier sheet 11 and cover sheet 13 are supplied in wide rolls and the outer edges 25, 26 (see FIG. 5) of the rolls are connected, preferably by sewing, as discussed below in connection with FIG. 4. The central portions of the primary carrier sheet 11 and cover sheet 13 must also be connected to provide a means for containing and supporting the bentonite 12, which is normally supplied in granular form.

The tufting process provides the above-mentioned connection between the central portions of the primary carrier sheet 11 and the cover sheet 13 and also helps maintain the position and distribution of the bentonite 12. A tufting thread 14 is supplied by tufting machine 15 (see FIG. 4) and the tufting thread 14 is reputedly punched through the cover sheet 13, through the bentonite layer 12 and through the primary carrier sheet 11 to leave a plurality of bight portions 16 disposed below the primary carrier sheet 11. As seen in FIG. 2, the tufting thread 14 provides a connection between the cover sheet 13 and the primary carrier sheet 11. There is no fabric-to-fabric contact between the cover sheet 13 and primary carrier sheet 11; the connection is made by the tufting thread 14. In order to prevent the bight portions 16 of the tufting thread 14 from pulling back through the primary carrier sheet 11, the bight portions 16 must he deformed or interlocked so that the bight portions 16 cannot easily pass through the primary carrier sheet 11 or otherwise the bight portion 16 must he attached to the undersurface of the primary carrier sheet 11.

One preferred method of preventing the migration of the bight portion 16 back through the primary carrier sheet 11 is to partially melt the bight portion 16. The threads known to be acceptable for use as a tufting thread 14 in a melting process include a polyester thread with a melting point of about 480° F., a nylon thread with a melting point of 414°–500° F., a polyethylene thread with melting point of about 266° F. or a polypropylene thread with a melting point of about 325° F. After a partial melting, the bight portions 16 will harden in a deformed state thereby precluding the bight portion 16 from migrating or otherwise passing back through the primary carrier sheet 11.

The preferred material for manufacturing the geosynthetic liner is a woven polypropylene fabric which melts at about 325° F. It is preferable, but not absolutely necessary, to select a tufting thread 14 with a similar or lower melting point than the primary carrier sheet 11. The bight portions 16 disposed below the primary carrier sheet 11 provide loops of thread below the primary carrier sheet. As seen below, a key feature of the present invention is means for preventing the loops or bight portions 16 disposed below the primary carrier sheet 11 from migrating back upward through the primary carrier sheet 11. The tufting thread 14 will normally be finer and easier to melt and therefore the melting point of the tufting thread need not be lower but should be similar to the melting point of the material that the primary carrier sheet 11 is fabricated from.

Figure 3:
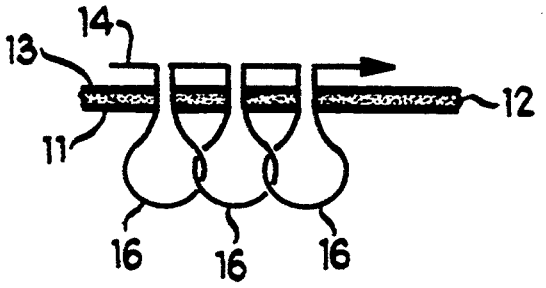
FIG. 3 is another illustration of the tufting thread extending through the secondary and primary carrier sheets, the bight portions disposed below the primary carrier sheet being interlocked together.
Figure 3B:
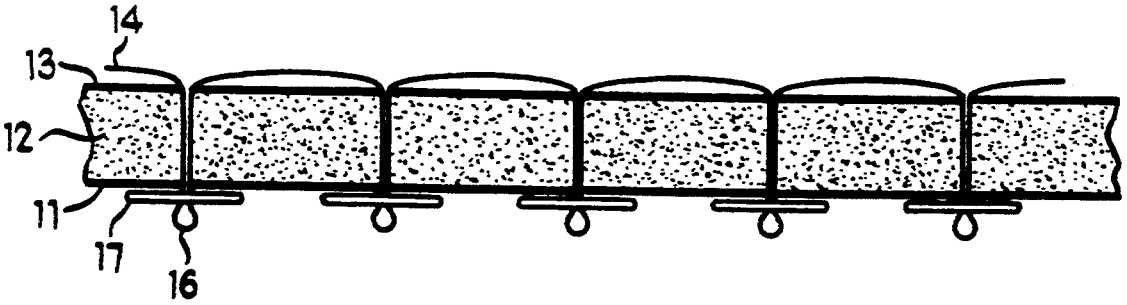
FIG. 3B is an illustration of bight portion passing through buttons disposed below the primary carrier sheet and attaching said buttons to the primary carrier sheet.
Figure 3A:
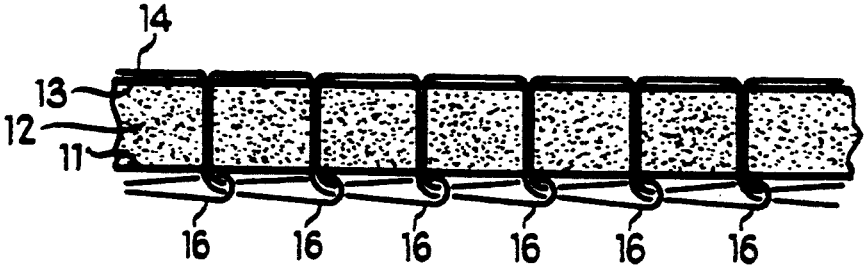
FIG. 3A is an additional illustration of bight portions disposed below the primary carrier sheet being interlocked together.

An alternative to melting the bight portions 16 is illustrated in FIG. 3 where the bight portions 16 are interlocked with each other thereby precluding them from passing back through the primary carrier sheet 11. The interlocking tufts illustrated in FIG. 3 is not the preferred method because the interlocked tufted connection requires a more intricate manufacturing process and the unmelted interlocked bight portions 16 do not provide as rough a surface as partially melted bight portions 16. An advantage of the interlocking tufts is that their use reduces the need for heat deformation of the tufts. An advantage, however, to melting the bight portions 16 is that the partially melted bight portions 16 are hard and somewhat irregular. The plurality of heat deformed bight portion 16 disposed on the underside of the primary carrier sheet 11 provides a rough surface with a high coefficient of friction that partially enables geosynthetic clay liner 10 to maintain its position on a steep slope or bank without sliding downward. FIG. 3A is an additional illustration of interlocked, adjacent bight portions 16.

Other alternatives not shown in the figures include knotting the bight portions 16, applying button-like structures to the bight portions 16, gluing the bight portions 16 to the undersurface of the primary carrier sheet 11 and other variations which are intended to impede the migration of the bight portions 16 back through the primary carrier sheet 11. FIG. 3B illustrates the attachment of buttons 17 to the primary carrier sheet 11 by passing the bight portions 16 through the buttons 17.

Figure 4:
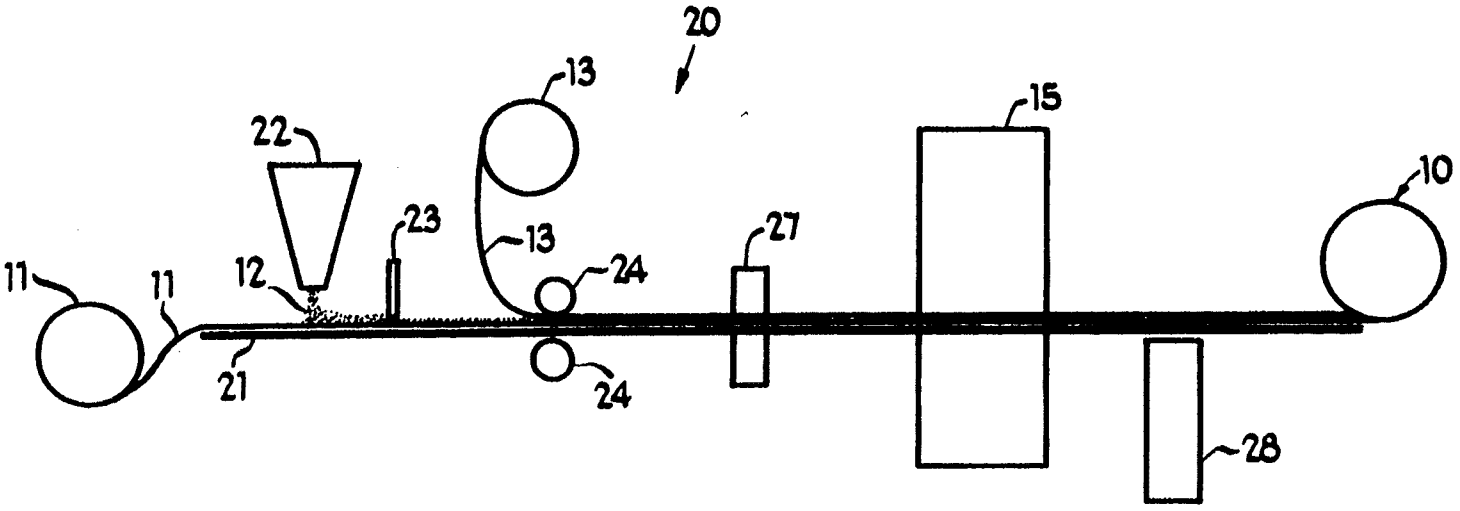
FIG. 4 is a schematic view of the method of manufacturing the geosynthetic clay liner of the present invention.

FIG. 4 illustrates the improved method of manufacturing the geosynthetic clay liner 10 of the present invention. In the manufacturing assembly line 20, a roll of primary carrier sheet material 11 is connected to a conveyor means 21. A supply of bentonite 12 is contained within a hopper 22 which deposits the bentonite 12 on the upper surface of the primary carrier sheet 11. A leveling device 23 (also known as a doctor bar 23) smooths the bentonite 12 to an even layer on top of the primary carrier sheet 11. A roll of cover sheet material 13 is provided and the cover sheet material 13 is deposited on top of the bentonite 12. Compression rollers 24 compact the cover sheet 13, the bentonite 12 and the primary carrier sheet 11 together to form the geosynthetic clay liner 10 with an even layer of bentonite 12. The outer edges 25, 26 (see FIG. 5) of the primary carrier sheet 11 and the cover sheet 13 are attached together at the edge sewing station 27. The liner 10 then proceeds through the tufting machine 15. As an alternative to or as an additional step, the liner 10 may be vibrated after the edges are sewn at 27 to further level out the bentonite layer 12. After the liner 10 exits the tufting machine 15, the bight portions 16 (see FIGS. 1 through 3) are melted by the tuft melting device 28 before the liner 10 is rolled up and made ready for shipment.

Figure 5:
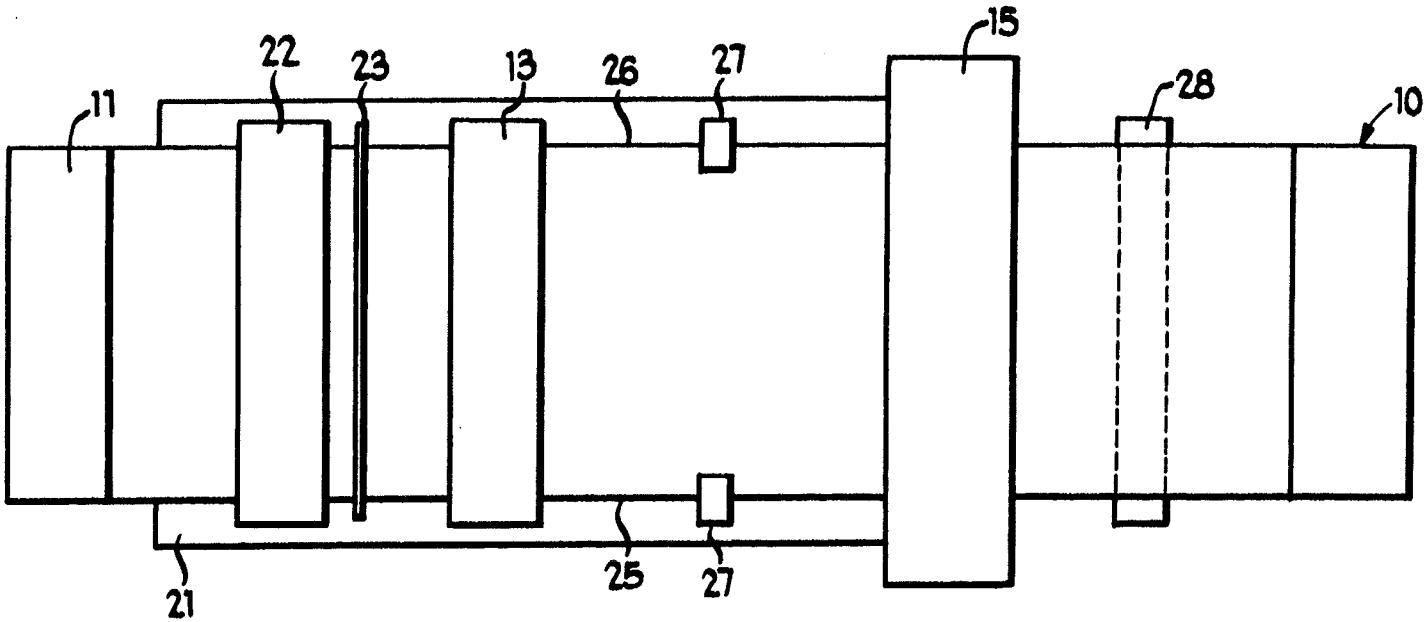
FIG. 5 is a top plan view of the schematic shown in FIG. 4.

In the preferred method of manufacturing illustrated in FIGS. 4 and 5, no steps involving the application of glue or adhesive are required. The outer edges 25, 26 of the primary carrier and cover sheets 11, 13 are preferably sewn together. The melting device 28 only partially melts the bight portions 16 of the tufting thread thereby limiting any noxious fumes that might be caused by overmelting or overheating the tufting thread. The polypropylene fabric that comprises the primary carrier sheet 11 is not substantially melted by the tuft melting device 28. Because no gluing steps are used, there is no need for a dryer or other drying device previously required by methods disclosed in the prior art. The fabricating method disclosed in FIGS. 4 and 5 is a fast and efficient way to manufacture geosynthetic clay liners.

Thus, a geosynthetic clay liner is made with a layer bentonite disposed between two primary carrier sheet and a cover sheet without the need for gluing the bentonite to the lower or primary carrier sheet. The sheets are connected via tufting threads, rather than sewing the sheets together. The undersurface of the liner includes a higher coefficient of friction than the undersurface of a primary carrier sheet due to the partially melted bight portions of the tufting threads. The geosynthetic clay liner is made without a glue or adhesive and further is suitable for installation on steep slopes or banks.

Although only preferred embodiment and method of the present invention has been illustrated and described, it will at once apparent to those skilled in the art that variations may be made within the spirit and scope of the invention. Accordingly, it is intended that the scope of the invention be limited solely by the scope of the hereafter appended claims and not by any specific wording and the foregoing description.

We claim:

1. A geosynthetic clay liner for use in forming a continuous clay layer, the geosynthetic clay liner comprising:

a primary carrier sheet for supporting a layer of bentonite, the primary carrier sheet including at least two outer edges, the layer of bentonite disposed on an upper surface of the primary carrier sheet, a cover sheet for enclosing the layer of bentonite between the primary carrier sheet and the cover sheet, the cover sheet including at least two outer edges, the cover sheet being disposed on top of the layer of bentonite, the outer edges of the cover sheet being in substantial matching registry with the outer edges of the primary carrier sheet, a plurality of tufted threads serving as a connection between the primary carrier sheet and the cover sheet, each tufted thread including a plurality of bight portions extending through the cover sheet and through the primary carrier sheet and being disposed below a lower surface of the primary carrier sheet, each of said bight portions forming a loop disposed below the lower surface of the primary carrier sheet, means for precluding the bight portions disposed below the lower surface of the primary carrier sheet from migrating back through the primary carrier sheet.

2. The geosynthetic clay liner of claim 1, wherein the means for precluding the bight portions disposed below the lower surface of the primary carrier sheet from migrating back through the primary carrier sheet is deformation of the bight portions thereby precluding the bight portions from migrating back through the primary carrier sheet.

3. The geosynthetic clay liner of claim 2, wherein the bight portions of the tufted threads that are disposed below the lower surface of the primary carrier sheet is at least partially melted.

4. The geosynthetic clay liner of claim 1, wherein the means for precluding the bight portions disposed below the lower surface of the primary carrier sheet from migrating back through the primary carrier sheet is a layer of adhesive applied to the bight portions disposed below the lower surface of the primary carrier sheet thereby adhering at least a portion of the bight portions to the lower surface of the primary carrier sheet.

5. The geosynthetic clay liner of claim 1, wherein the means for precluding the bight portions disposed below the lower surface of the primary carrier sheet from migrating back through the primary carrier sheet is a bight portion extending through an adjacent bight portion.

6. The geosynthetic clay liner of claim 1, wherein the means for precluding the bight portions disposed below the lower surface of the primary carrier sheet from migrating back through the primary carrier sheet is fastening buttons to the tufted bight portions below the lower surface of the primary carrier.

7. The geosynthetic clay liner of claim 1, wherein the outer edges of the primary carrier sheet and the outer edges of the cover sheet are attached.

8. The geosynthetic clay liner of claim 7, wherein the outer edges of the primary carrier sheet and the outer edges of the cover sheet are attached by sewing.

9. The geosynthetic clay liner of claim 7, wherein the outer edges of the primary carrier sheet and the outer edges of the cover sheet are attached by gluing.

10. A geosynthetic clay liner for use in forming a continuous clay layer, the geosynthetic clay liner comprising:

a primary carrier sheet for supporting a layer of bentonite, the primary carrier sheet including at least two outer edges, the layer of bentonite disposed on an upper surface of the primary carrier sheet, a cover sheet for enclosing the layer of bentonite between the primary carrier sheet and the cover sheet, the cover sheet including at least two outer edges, the cover sheet being disposed on top of the layer of bentonite, the outer edges of the cover sheet being in substantial matching registry with the outer edges of the primary carrier sheet, a plurality of tufting threads serving as a connection between the primary carrier sheet and the cover sheet, each tufting thread including a plurality of bight portions extending through the cover sheet and through the primary carrier sheet and being disposed below a lower surface of the primary carrier sheet, the bight portions disposed below the primary carrier sheet are deformed thereby providing deformed bight portions disposed below the primary carrier sheet that are precluded from migrating back through the primary carrier sheet.

11. The geosynthetic clay liner of claim 10, wherein the deformed bight portions of the tufting threads are at least partially melted.

12. A geosynthetic clay liner for use in forming a continuous clay layer, the geosynthetic clay liner comprising:

a primary carrier sheet for supporting a layer of bentonite, the primary carrier sheet including at least two outer edges, the layer of bentonite disposed on an upper surface of the primary carrier sheet, a cover sheet for enclosing the layer of bentonite between the primary carrier sheet and the cover sheet, the cover sheet including at least two outer edges, the cover sheet being disposed on top of the layer of bentonite, the outer edges of the cover sheet being in substantial matching registry with the outer edges of the primary carrier sheet, a plurality of tufting threads serving as a connection between the primary carrier sheet and the cover sheet, each tufting thread including a plurality of bight portions extending through the cover sheet and through the primary carrier sheet and being disposed below a lower surface of the primary carrier sheet, the bight portions disposed below the primary carrier sheet are attached to the lower surface of the primary carrier sheet by adhesive thereby precluding the bight portions from migrating back through the primary carrier sheet.

13. A geosynthetic clay liner for use in forming a continuous clay layer, the geosynthetic clay liner comprising:

a primary carrier sheet for supporting a layer of bentonite, the primary carrier sheet including at least two outer edges, the layer of bentonite disposed on an upper surface of the primary carrier sheet, a cover sheet for enclosing the layer of bentonite between the primary carrier sheet and the cover sheet, the cover sheet including at least two outer edges, the cover sheet being disposed on top of the layer of bentonite, the outer edges of the cover sheet being in substantial matching registry with the outer edges of the primary carrier sheet, a plurality of tufting threads serving as a connection between the primary carrier sheet and the cover sheet, each tufting thread including a plurality of bight portions extending through the cover sheet and through the primary carrier sheet and being disposed below a lower surface of the primary carrier sheet, the bight portions disposed below the primary carrier sheet extend through an adjacent bight portion thereby precluding the bight portions and adjacent bight portions from migrating back through the primary carrier sheet.

* * * * *

UNITED STATES PATENT AND TRADEMARK OFFICE

CERTIFICATE OF CORRECTION

PATENT NO. : 5,436,050

DATED : JULY 25, 1995

INVENTORS : CARRIKER, ET AL.

It is certified that error appears in the above-identified patent and that said Letters Patent is hereby corrected as shown below:

Column 5, line 33, "is reputedly" should be -- is repeatedly --.

Column 5, line 45, "must he" should be -- must be --.

Column 5, line 48, "he attached" should be -- be attached --.

Column 7, line 29, "only preferred" should be -- only one preferred --.

Signed and Sealed this

Twelfth Day of March, 1996

Bruce Lehman

*Attest:*

BRUCE LEHMAN

*Attesting Officer*

*Commissioner of Patents and Trademarks*